US006135727A

United States Patent [19]

Dreiman et al.

[11] Patent Number: 6,135,727

[45] Date of Patent: Oct. 24, 2000

[54] DETACHABLY AFFIXED COUNTERWEIGHT AND METHOD OF ASSEMBLY

[75] Inventors: Nelik I. Dreiman, Tipton; Emanuel Duane Fry, Tecumseh, both of Mich.

[73] Assignee: Tecumseh Products Company, Tecumseh, Mich.

[21] Appl. No.: 09/250,576

[22] Filed: Feb. 16, 1999

[51] Int. Cl.[7] ..... F04B 17/00

[52] U.S. Cl. ..... 417/415; 418/151; 74/603

[58] Field of Search ..... 417/415, 53, 521; 418/151; 74/603, 604; 92/128, 140

[56] References Cited

U.S. PATENT DOCUMENTS

| | | | |
|---|---|---|---|
| 1,248,832 | 6/1917 | Dunn | 74/603 |
| 1,255,409 | 2/1918 | Gordon | 74/603 |
| 1,259,086 | 3/1918 | Dunn | 74/603 |
| 1,383,488 | 7/1921 | Schaffer | 74/603 |
| 1,605,986 | 11/1926 | Redfield | 74/603 |
| 2,344,430 | 3/1944 | Vaughan et al. | 74/604 |
| 3,074,293 | 1/1963 | Langsetmo | 74/573 |
| 3,403,846 | 10/1968 | Parker | 203/206 |
| 3,581,599 | 6/1971 | Lee et al. | 74/603 |
| 3,587,343 | 6/1971 | Mahncke et al. | 74/603 |
| 3,673,651 | 7/1972 | Stewart | 29/6 |
| 4,739,679 | 4/1988 | Berger et al. | 74/574 |
| 4,834,627 | 5/1989 | Gannaway | 417/415 |
| 4,915,594 | 4/1990 | Lammers | 417/265 |
| 4,966,042 | 10/1990 | Brown | 74/44 |

*Primary Examiner*—Timothy S. Thorpe
*Assistant Examiner*—Timothy P Solak
*Attorney, Agent, or Firm*—Baker & Daniels

[57] ABSTRACT

A compressor or pump assembly including a housing, a compression mechanism disposed within the housing, a shaft operatively connecting the compression mechanism and a drive source, the shaft having an axis of rotation and first and second surfaces, the shaft axis of rotation disposed between the first and second shaft surfaces, and a counterweight disposed about the shaft and comprising first and second portions, the first counterweight portion generally U-shaped, having first and second arms, the first arm in contact with the first shaft surface, the second arm in contact with the second shaft surface, the second counterweight portion extending between the first and second arms and attached to the first counterweight portion, the shaft captured between the first and second counterweight portions, whereby rotation is imparted to the counterweight through the interface of the shaft surfaces and the arms.

23 Claims, 4 Drawing Sheets

DETACHABLY AFFIXED COUNTERWEIGHT AND METHOD OF ASSEMBLY

BACKGROUND OF THE INVENTION

The present invention pertains to counterweights used in pumps and compressors, and particularly to counterweights used in reciprocating piston compressors.

Typically, compressors and pumps are provided with an eccentric affixed to the rotating shaft, through which the shaft is operatively connected to the compression mechanism for driving same. Centrifugal forces associated with the eccentric and/or the compression mechanism connected thereto must ordinarily be balanced to provide quiet operation of the compressor. Reciprocating piston compressors, such as the scotch yoke type compressor disclosed in U.S. Pat. No. 4,834,627, which is assigned to the present assignee, the disclosure of which is incorporated herein by reference, require counterweights rotatably fixed to the rotating shaft to reduce or remove force fluctuations associated with piston reciprocation and/or the forces acting on the pistons by the compressed fluid. The above-referenced scotch yoke compressor has its eccentric positioned between two journaled shaft portions, and has one counterweight portion integrally formed on the shaft located adjacent to the eccentric, between the eccentric and one of the journal bearings provided in the compressor crankcase. The other journal bearing is provided in a separate plate or cover removably attached to the crankcase, over an access or pilot hole through which the shaft is inserted through the first journal bearing and the assembly of the slide block and the other members of the scotch yoke assembly is performed, connecting the eccentric to the pistons.

To reduce the load on each journal bearing, it is preferable to have counterweights on each axial side of the eccentric. However, because of the necessary access for connection of the compression mechanism to the shaft eccentric, a second counterweight located adjacent the eccentric and between the eccentric and the portion of the shaft journaled in the removably attached cover or bearing plate may not be integrally formed in the shaft like the other counterweight is. The previous, above-referenced compressor therefore provides a counterweight attached to the axial end of the shaft, on the side of the bearing plate's journal bearing opposite the eccentric. The embodiment of the present invention shown in the figures is also a scotch yoke type compressor, similar to that disclosed in the above-cited U.S. patent. The counterweight attached to the axial end of the shaft of that compressor is, for background discussion purposes only, included in FIG. 1 and identified with reference numeral 10. Counterweight 10 is shown in ghosted lines and comprises no part of the present invention. The location of counterweight 10 is not optimal, for the counterweight attached to the axial end of the shaft and the integral counterweight are not located equidistantly from the eccentric. Both counterweights should be located equidistantly from the eccentric and between the two journal bearings to optimally load the bearings and provide quiet operation of the compressor. A way of providing a pair of counterweights on opposite axial sides of the eccentric and between the journal bearings while allowing access through the pilot hole for assembly of the compression mechanism to the eccentric is desirable.

SUMMARY OF THE INVENTION

The present invention addresses this shortcoming of the previous, above-described scotch yoke type compressor, and provides an improvement in the way counterweights are attached to the rotating shafts of pumps and compressors in general, where assembly access may otherwise be restricted and balancing compromised.

The present invention provides a compressor or pump assembly having a housing, a compression mechanism disposed within the housing, and a shaft operatively connecting the compression mechanism and a drive source. The shaft has an axis of rotation and first and second surfaces, the shaft axis of rotation disposed between the first and second surfaces. A counterweight is disposed about the shaft and comprises first and second portions. The first counterweight portion is generally U-shaped, having first and second arms, the first arm in contact with the first shaft surface, the second arm in contact with the second shaft surface. The second counterweight portion extends between the first and second arms and is attached to the first counterweight portion, the shaft captured between the first and second counterweight portions. Rotation is imparted to the counterweight through the interface of the shaft surfaces and the arms.

The present invention also provides a method of attaching a counterweight to a pump or compressor crankshaft, the method including the steps of: providing a crankshaft with first and second surfaces, and a counterweight having first, substantially U-shaped portion with first and second arms and a second portion; straddling the crankshaft with the first counterweight portion, sliding the arms of the first counterweight portion over the crankshaft surfaces; overlying the first and second counterweight portions, whereby the counterweight surrounds the crankshaft; and attaching the first and second counterweight portions to one another.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
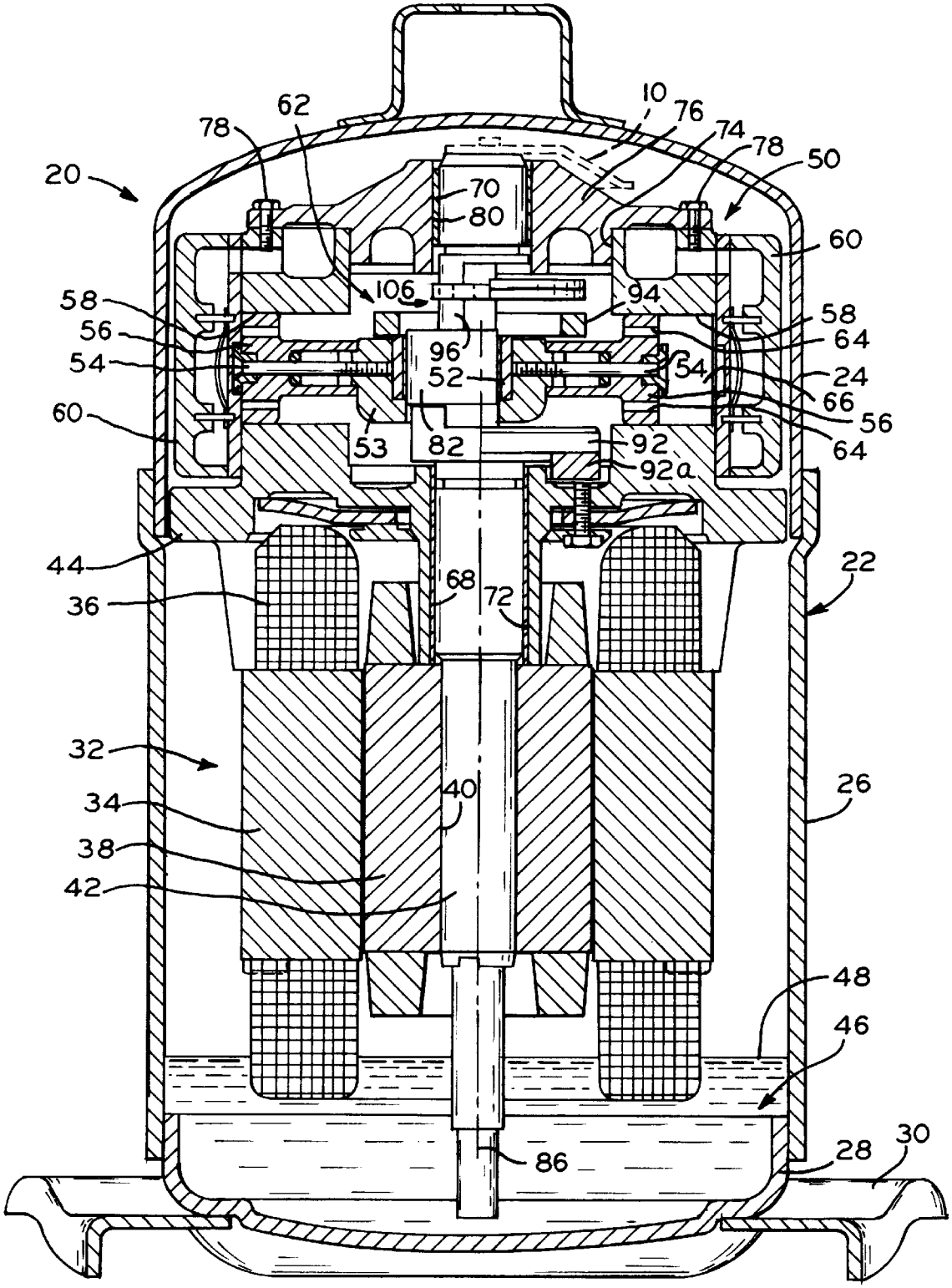
FIG. 1 is a sectional side view showing one embodiment of a compressor assembly comprising a counterweight according to the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, in several forms, and such exemplifications are not to be construed as limiting the scope of the invention in any manner.

DETAILED DESCRIPTION OF THE INVENTION

Referring to FIG. 1 there is shown compressor or pump assembly 20, which is part of a refrigeration or air conditioning system (not shown). Compressor assembly 20 has housing 22 which is comprised of top portion 24, middle portion 26 and bottom portion 28. The housing portions are welded or brazed together. Mounting bracket 30 is attached to bottom housing portion 28 for securely attaching the compressor assembly to a base (not shown).

Located within hermetically sealed housing 22 is electric motor assembly 32 having stator 34 provided with windings 36, and rotor 38 provided with central aperture 40 in which crankshaft 42 is secured by means of an interference fit. A terminal cluster (not shown) is provided in housing 22 for connecting motor assembly 32 to a source of electrical power for causing rotor 38 and attached crankshaft 42 to rotate. Stator 34 is supported in housing 22 by means of its attachment to crankcase 44.

The lower interior portion of housing 22 serves as a sump 46 for oil. One end of crankshaft 42 is suspended below surface 48 of the oil, and is provided with an oil pump and conduit (not shown) through which oil may be drawn from sump 46 through the crankshaft to moving parts of the compressor assembly in the known manner, to lubricate same.

The opposite end of crankshaft 42 drivingly attaches rotor 38 to compression mechanism 50 which, in the shown embodiment is a reciprocating piston type provided with slide block 52 and an associated, 2-piece scotch yoke mechanism of known type. Attached to first scotch yoke member 53, by means of bolts 54, are four piston assemblies 56 which reciprocate in radial cylinders 58 provided in crankcase 44. Heads 60 are attached to crankcase 44 over cylinders 58 and direct the flow of discharge pressure gas from the cylinders into housing 22; compressor assembly 20 is thus a high-side compressor, with motor assembly 32 exposed to discharge pressure gases. Discharge gases from housing 22 are directed to the remainder of the refrigerant system loop. Cylinders 58 are in communication with suction pressure space 62. Passages 64 in piston assemblies 56 provide a path through which suction gases may flow from space 62 to compression spaces 66 between the piston faces and heads 60, the piston faces provided with suction valve plates (not shown) which overlie passages 64.

Crankshaft 42 is journalled within axially aligned bearings 68, 70, with bearing 68 fitted within central bore 72 provided in crankshaft 44. Crankshaft 44 is provided with relatively large pilot hole 74 into which bearing plate 76 fitted, the bearing plate attached to the crankcase by means of bolts 78. Bearing plate 76 is provided with central bore 80 into which bearing 70 is fitted.

Figure 2B:
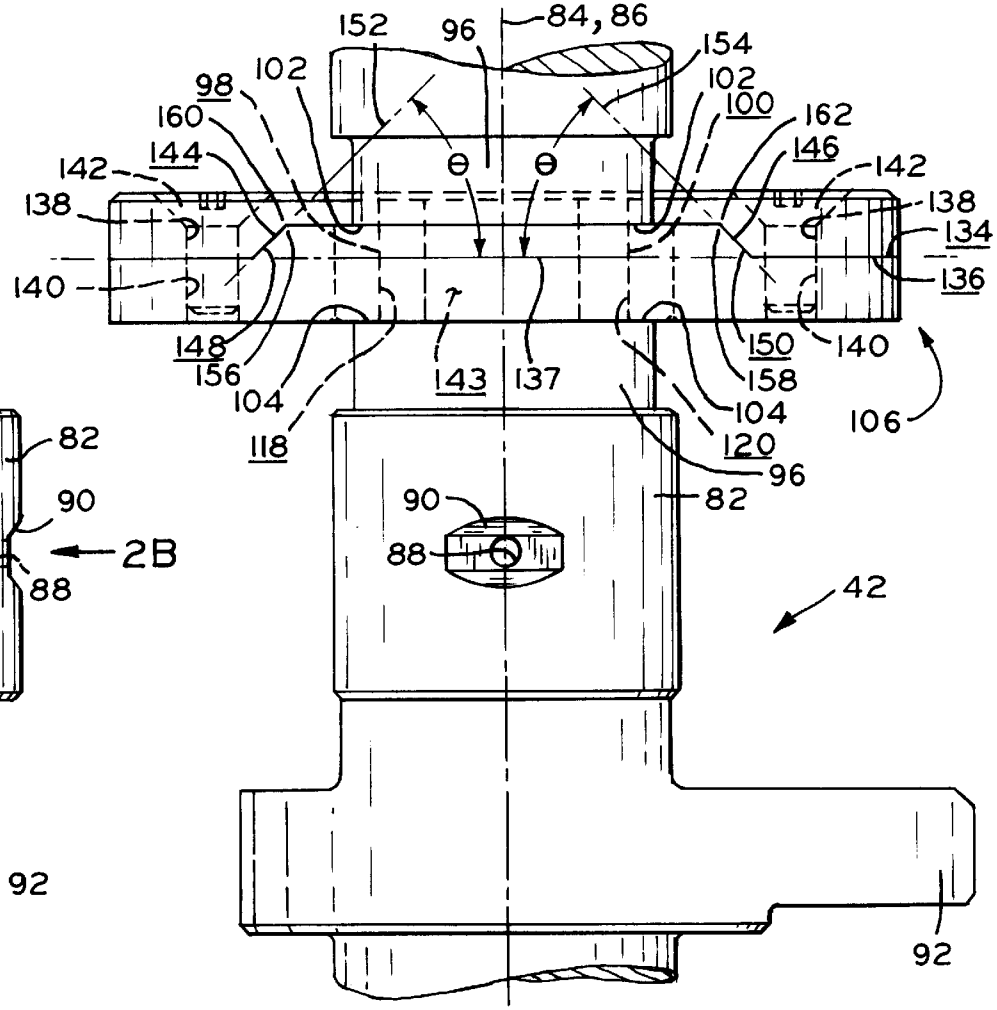
FIG. 2B is a fragmentary side view of the crankshaft of FIG. 2A in the direction of arrow 2B, also showing one embodiment of a counterweight according to the present invention attached thereto.
Figure 2A:
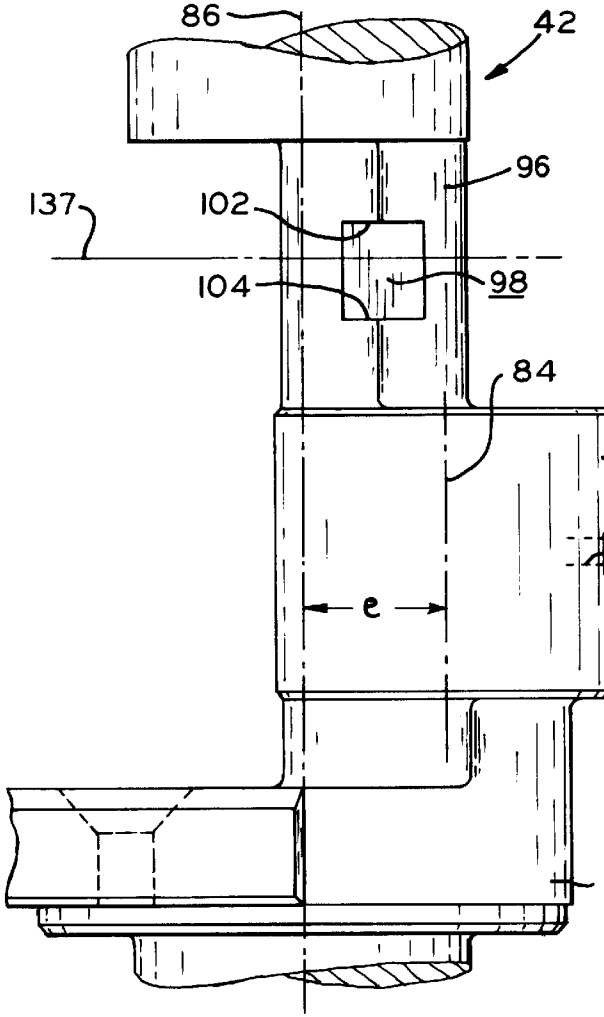
FIG. 2A is an enlarged, fragmentary side view of the crankshaft of the compressor assembly shown in FIG. 1.

Disposed between bearings 68, 70, within suction pressure gas space 62 is cylindrical eccentric 82 having a central axis 84 (FIG. 2A) radially offset by distance e from crankshaft axis of rotation 86. Eccentric 82 may be integrally cast and machined into crankshaft 42, and may be provided with radially-extending aperture 88 which communicates with the oil-conveying conduit (not shown) which extends along the length of the crankshaft. Aperture 88 opens into recess 90 in the cylindrical surface of the eccentric and provides a supply of oil to the interface between the outer surface of the eccentric and the inner surface of slide block 52. Crankshaft 42 is also provided with counterweight portion 92 which may be completely integrally cast and machined into the crankshaft, or which may, in part, be an assembly as shown. Counterweight portion 92 is disposed adjacent eccentric 82 and is disposed within suction pressure space 62. Also disposed within space 62, adjacent the axial side of eccentric 82 opposite counterweight portion 92, is second scotch yoke member 94.

As indicated above, crankshaft 42 is guided through pilot hole 74 as it is inserted into crankcase bore 72. Moreover, the assembly of the first and second scotch yoke members about eccentric 82 and slide block 52 within space 62 is accessed through pilot hole 74 prior to assembly of bearing plate 76 to crankcase 44. To provide counterweights on both sides of eccentric 82 and between bearings 68, 70, shaft 42 is provided with portion 96 of generally elliptical cross section, the oppositely remote radial surfaces of which are provided with flat surfaces 98, 100 which lie in parallel planes which are also parallel to and equidistant from axes 84, 86. The provision of flat surfaces 98, 100 in shaft portion 96 also forms shoulders 102, 104 therein, the shoulders lying in planes normal to axes 84, 86.

With reference now to FIGS. 2B and 3A–D, counterweight 106 is detachably affixed to crankshaft portion 96 and is comprised of interconnecting base portion 108 and insert portion 110, each of which are substantially rigid and may be formed of sintered powdered metal, for example. Base portion 108 is somewhat U-shaped, having projecting arms 112, 114 and intermediate portion 116. Base portion 108 is disposed about shaft portion 96 in straddling fashion, with flat shaft surfaces 98, 100 slidably contacting interfacing flat, parallel surfaces 118, 120 of arms 112, 114, respectively. Interior surface 122 of intermediate portion 116 abuts the adjacent surface of shaft portion 96 between its flat surfaces 98, 100. Arms 112, 114 are each provided with respective surfaces 124, 126 which diverge from surfaces 118, 120 to provide the necessary clearance to accommodate base portion 108 within the annular space between the upper portion of shaft 42 and pilot hole 74. Once base portion 108 has been lowered into space 62, with diverging surfaces 124, 126 sliding past shaft 42, the base portion is fitted about shaft 96, surfaces 118, 120 and 98, 100 in respective sliding contact with each other, as described above. Counterweight 106 is prevented from moving axially along shaft 42 by the abutment of shaft shoulders 102, 104 with the closely adjacent portions of base portion axial surfaces 128, 130.

Counterweight insert portion 110 is inserted into space 62 through pilot hole 74 to an overlying position atop base portion 108, and extends between arms 112, 114 thereof. Insert portion 110 is provided with a central projecting portion which depends into the space between diverging surfaces 124, 126 of base portion 108. Base and insert portions 108, 110 have respective interfacing axial surfaces 134, 136 which lie parallel to plane 137, which is normal to axis of rotation 86. Insert portion 110 is provided with a pair of countersunk holes 138 which align with tapped holes 140 provided in base portion 108. Screws 142 are inserted into holes 138 and are threadedly engaged with tapped holes 140; the screws are placed and tightened through pilot hole 74. With insert portion 110 so positioned on base portion 108, with holes 138 and 140 aligned, curved surface 143 of the insert portion abuts the adjacent surface of shaft portion 96 and counterweight 106 thus surrounds shaft 42.

Figure 3C:
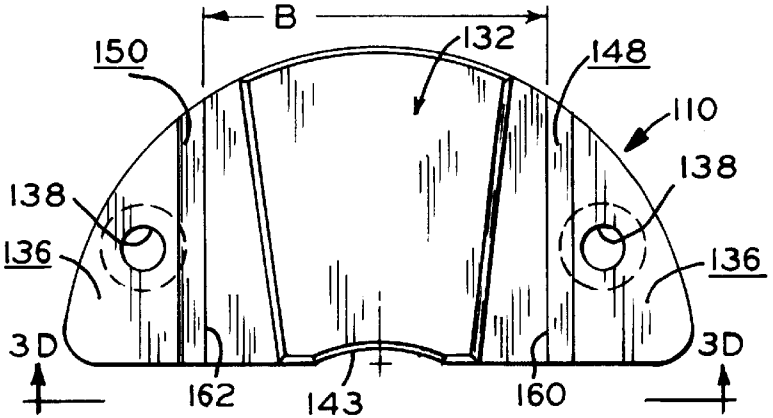
FIG. 3C is an end view of the insert portion of the counterweight shown in FIG. 2B.
Figure 3D:
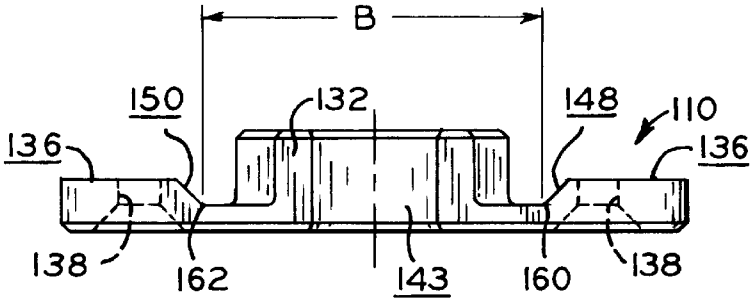
FIG. 3D is a side view of the counterweight insert portion of FIG. 3C.
Figure 3A:
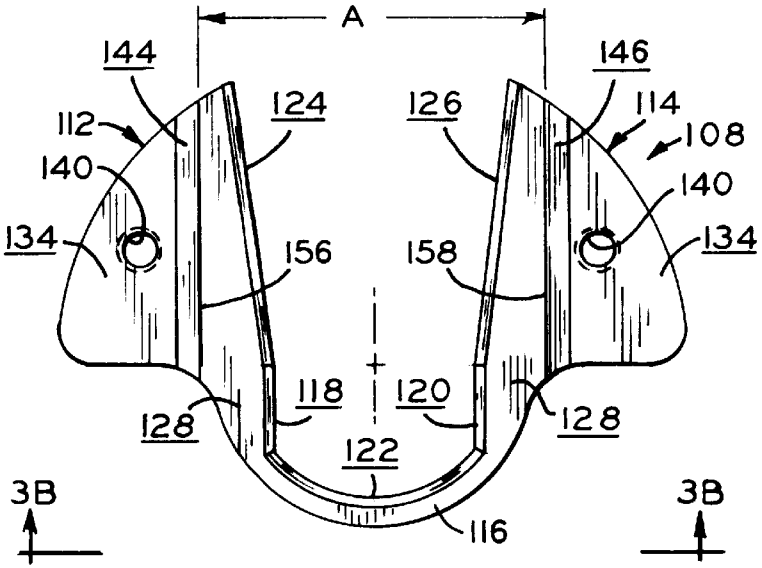
FIG. 3A is an end view of the base portion of the counterweight shown in FIG. 2B.
Figure 3B:
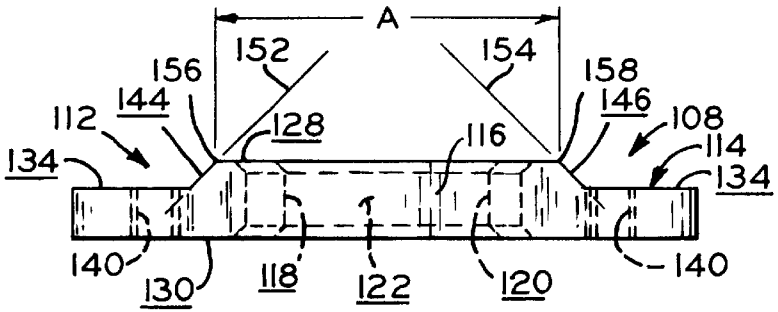
FIG. 3B is a side view of the counterweight base portion of FIG. 3A.
Figure 4:
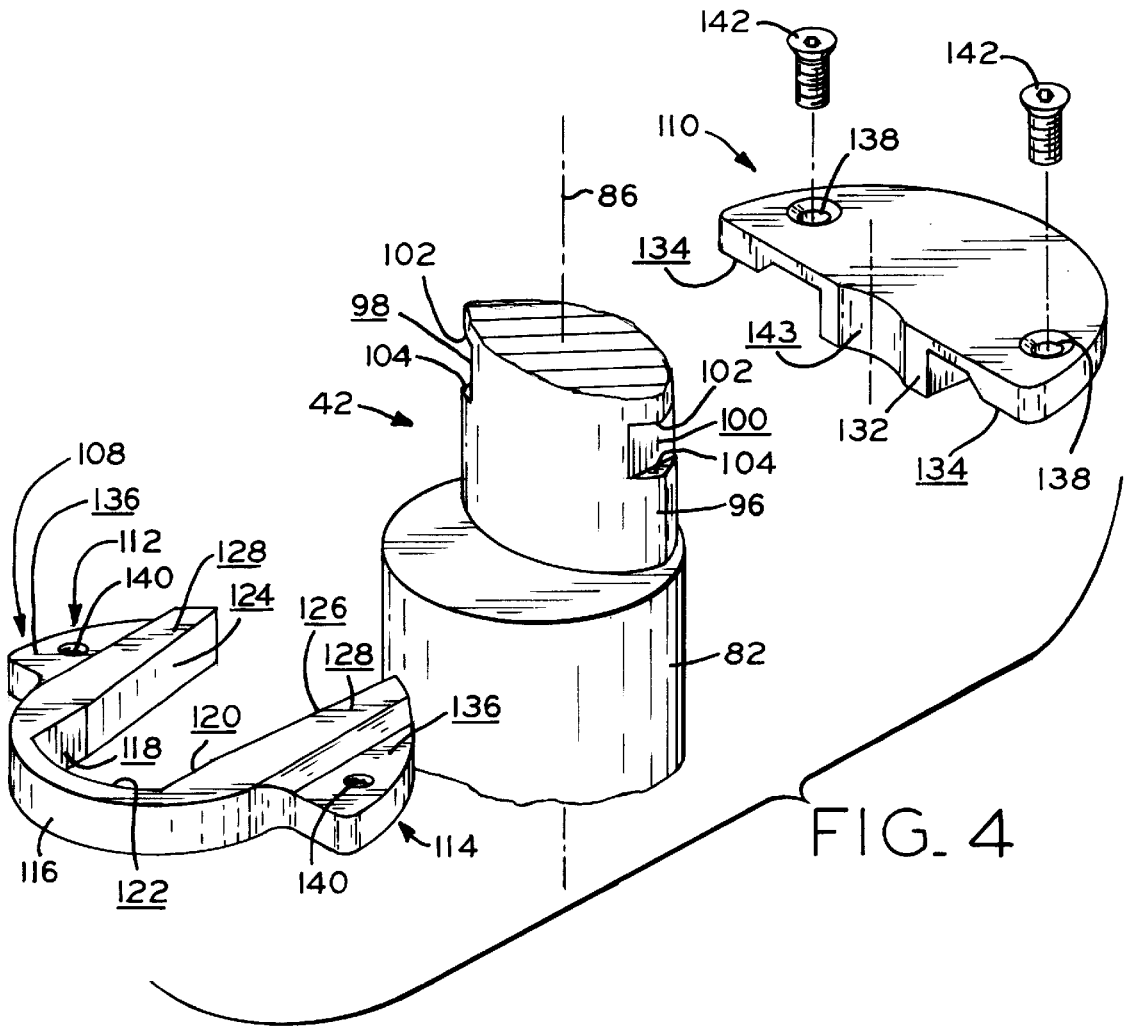
FIG. 4 is a fragmentary, exploded view of the crankshaft and counterweight assembly of FIG. 2B.

Referring to FIGS. 3B and 3D, counterweight base and insert portions 108, 110 are also provided with respective first and second angled surfaces 144, 146, 148, 150. First angled surfaces 144, 148 form a first interfacing pair and, when assembled, lie along plane 152 (FIGS. 2B, 3B), whereas second angled surfaces 146, 150 form a second interfacing pair which lie along plane 154. Planes 152, 154 each form an acute angle θ (FIG. 2B) of at least about 30° with plane 137 such that planes 152, 154 will intersect between surfaces 118, 120, forming a line (not shown) which is perpendicular to axis of rotation 84. First and second angled surfaces 144, 146 of base portion 108 have respective, parallel inner edges 156, 158 which are also generally parallel with surfaces 118, 120. Edges 156, 158 are separated by distance A as shown in FIGS. 3A, 3B. Similarly, First and second angled surfaces 148, 150 of insert portion 110 have respective, parallel inner edges 160, 162, which are parallel with edges 156, 158. Edges 160, 162 are separated by distance B as shown in FIGS. 3C, 3D. Distance A is greater than distance B, therefore, as interfacing axial surfaces 134, 136 are forced into closer proximity by the tightening of screws 142, increasing compressive forces are brought to bear between first and second angled surface pairs 144, 148 and 146, 150. As a result of the increasing forces acting on base portion angled surfaces 144, 146, arms 112, 114 are urged together such that the shaft portion 96 is tightly clamped at flat surfaces 98, 100 by the engaging surfaces 118, 120 of base portion 108. In this way, counterweight is securely fastened to shaft 42.

Figure 5:
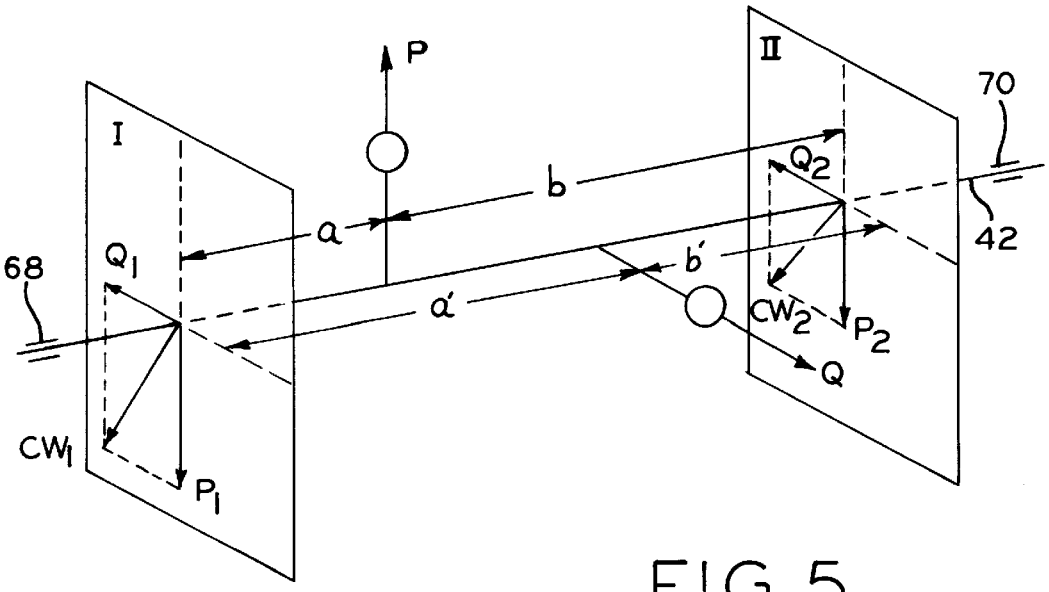
FIG. 5 is a schematic force diagram for the inventive compressor embodiment shown in FIG. 1.

FIG. 5 is a schematic force and moment diagram for the inventive compressor embodiment shown in FIG. 1, showing the locations and magnitudes of counterweights 92 and 106, which respectively lie in planes I and II, for optimally counterweighting the centrifugal forces acting on the eccentric of shaft 42. Notably, planes I and II lie between bearings 68 and 70; as described above, eccentric 82 lies between planes I and II. During steady state operation of compressor assembly 20, rotating imbalances in rotor 38, shaft 42 and eccentric 82, the movement of reciprocating compression mechanism piston assemblies 56, as well as forces exerted on the piston assemblies by the compressed gas within cylinders 58, result in centrifugal forces P and Q acting on the eccentric. Given the location of counterweights in planes I and II, the axial distances of force P from planes I and II are identified in FIG. 5 as "a" and "b", respectively. Similarly, the respective axial distances of force Q from planes I and II are "a" and "b". Those skilled in the art will recognize that the magnitude of counterweights 92 and 106 may be determined through use of the following equations, with reference to FIG. 5:

$$P_1+P_2=P \quad (1)$$

$$P_1a=P_2b \quad (2)$$

$$Q_1+Q_2=Q \quad (3)$$

$$Q_1a'=Q_2b' \quad (4)$$

Resultant force $CW_1$ of $P_1$ and $Q_1$ in plane I and resultant force $CW_2$ of $P_2$ and $Q_2$ in plane II represent the magnitudes of the correction weights provided by counterweights 92 and 106, respectively, necessary to complete the balancing. It should be noted that in some embodiments, a and a', as well as b and b', may be equivalent distances.

Integrally formed counterweight portion 92 of shaft 42 may be appropriately weighted and configured relative to axis 86 during casting and machining of the shaft. Alternatively, portions of counterweight 92, such as portion 92*a* (FIG. 1), may be assembled thereto by means of fasteners prior to installation of shaft 42 into the crankcase.

The orientation of shaft flat surfaces 98, 100, and the configurations of base and insert portions 108, 110 of counterweight 106 such that when assembled about shaft portion 96, the center of mass of the counterweight is appropriately positioned relative to axis of rotation 86. Further, the choice of material from which the counterweight base and insert portions are made may be considered in designing the specific configuration of counterweight 106, for it is envisioned that materials of various densities may be used.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor or pump assembly comprising:

a housing;

a compression mechanism disposed within said housing;

a shaft operatively connecting said compression mechanism and a drive source, said shaft having an axis of rotation and first and second surfaces, said shaft axis of rotation disposed between said first and second shaft surfaces; and a counterweight disposed about said shaft and comprising first and second portions, said first and second counterweight portions each being substantially rigid, said first counterweight portion generally U-shaped, having first and second arms, said first arm in contact with said first shaft surface, said second arm in contact with said second shaft surface, said second counterweight portion extending between said first and second arms and attached to said first counterweight portion, said shaft captured between said first and second counterweight portions;

whereby rotation is imparted to said counterweight through said the interface of said shaft surfaces and said arms.

2. The compressor or pump assembly of claim 1, wherein said shaft is provided with at least one shoulder adjacent at least one of said first and second shaft surfaces, whereby said counterweight is restricted from movement in the direction of said axis of rotation.

3. The compressor or pump assembly of claim 2, wherein said at least one shaft shoulder lies substantially in a plane normal to said axis of rotation.

4. The compressor or pump assembly of claim 1, wherein said first and second shaft surfaces are substantially flat.

5. The compressor or pump assembly of claim 4, wherein said first and second shaft surfaces lie in substantially parallel planes.

6. The compressor or pump assembly of claim 1, wherein said drive source is an electric motor.

7. The compressor or pump assembly of claim 6, wherein said motor is disposed in said housing.

8. The compressor or pump assembly of claim 1, wherein said shaft is provided with an eccentric portion adjacent said counterweight.

9. The compressor or pump assembly of claim 8, wherein said shaft is radially supported by a pair of bearings, said eccentric portion and said counterweight disposed between said bearings.

10. The compressor or pump assembly of claim 9, wherein said counterweight is a first counterweight, and further comprising a second counterweight rotatably fixed to said shaft, said eccentric portion disposed between said first and second counterweights, said first and second counterweights disposed between said bearings.

11. The compressor or pump assembly of claim 1, wherein said first and second arms are provided with respective first and second surfaces which respectively slidably contact said first and second shaft surfaces.

12. The compressor or pump assembly of claim 11, wherein said first and second shaft surfaces and said first and second arm surfaces are substantially flat.

13. The compressor or pump assembly of claim 12, wherein said first and second shaft surfaces and said first and second arm surfaces substantially lie in substantially parallel planes.

14. The compressor or pump assembly of claim 1, wherein said axis of rotation is substantially normal to a first plane, said first and second counterweight portions having interfacing axial surfaces which are substantially parallel with said first plane.

15. The compressor or pump assembly of claim 14, wherein said interfacing axial surface of said first counterweight portion comprises surfaces of said first and second arms.

16. The compressor or pump assembly of claim 15, wherein said first and second counterweight portions each have at least two angled surfaces, each of said four angled surfaces being nonparallel with said first plane, said first and second counterweight portions being in contact through two abutting pairs of said angled surfaces, one said angled surface of each said abutting pair of said angled surfaces being provided on each said arm of said first counterweight portion, the other said angled surface of each said abutting pair of said angled surfaces being provided on said second counterweight portion, each said angled surface of said first counterweight portion having an inner edge and an outer edge, each said outer edge radially farther from said axis of rotation than its adjacent inner edge, said inner edges of said first counterweight portion separated by a first distance, said inner edges of said second counterweight portion separated by a second distance, said first distance greater than said second distance, whereby said arms are urged into increasing compressive contact with said shaft surfaces as said interfacing axial surfaces are brought into closer proximity to one another.

17. The compressor or pump assembly of claim 16, wherein one pair of said abutting angled surfaces interface substantially along a second plane, and the other pair of said abutting angled surfaces interface substantially along a third plane, said second and third planes each having an acute angle with said first plane and intersect along a line which lies radially between said first and second shaft surfaces, whereby said arms are urged into increasing compressive contact with said shaft surfaces as said interfacing axial surfaces are brought into closer proximity to one another.

18. The compressor or pump assembly of claim 17, wherein each said acute angle is at least about 30°.

19. The compressor or pump assembly of claim 15, further comprising means for clamping said shaft between said arms as said axial interfacing surfaces are brought into closer engagement with each other.

20. The compressor or pump assembly of claim 1, wherein said first and second counterweight portions are threadedly attached to one another.

21. A method of attaching a counterweight to a pump or compressor crankshaft, comprising the steps of:

providing a crankshaft with first and second surfaces, and a counterweight having first, substantially U-shaped portion with first and second arms and a second portion;

straddling the crankshaft with the first counterweight portion, sliding the arms of the first counterweight portion over the crankshaft surfaces;

overlying axially interfacing surfaces of the first and second counterweight portions, whereby the counterweight surrounds the crankshaft; and attaching the first and second counterweight portions to one another.

22. The method of claim 21, further comprising the steps of:

bringing the first and second counterweight portions into increasingly tighter engagement with one another;

clamping the first and second arms against their adjacent crankshaft surfaces.

23. The method of claim 21, wherein said attaching step comprises the steps of:

inserting a screw into a hole provided in one of the first and second counterweight portions; and engaging the threads of a screw with mating threads provided in the other of the first and second counterweight portions.

* * * * *